US007220135B1

(12) United States Patent
Brekosky et al.

(10) Patent No.: US 7,220,135 B1
(45) Date of Patent: May 22, 2007

(54) PRINTED CIRCUIT BOARD STACKING CONNECTOR WITH SEPARABLE INTERFACE

(75) Inventors: Lawrence J Brekosky, Dillsburg, PA (US); Keith E Miller, Manheim, PA (US)

(73) Assignee: Tyco Electronics Corporation, Middletown, PA (US)

( * ) Notice: Subject to any disclaimer, the term of this patent is extended or adjusted under 35 U.S.C. 154(b) by 0 days.

(21) Appl. No.: 11/270,171

(22) Filed: Nov. 9, 2005

(51) Int. Cl.
*H01R 12/00* (2006.01)

(52) U.S. Cl. ..... 439/75

(58) Field of Classification Search ..... 439/70, 439/75, 74, 751
See application file for complete search history.

(56) References Cited

U.S. PATENT DOCUMENTS

| | | | | |
|---|---|---|---|---|
| 3,663,931 | A * | 5/1972 | Brown | 439/70 |
| 3,812,381 | A | 5/1974 | Guyton | |
| 4,526,429 | A * | 7/1985 | Kirkman | 439/82 |
| 4,534,603 | A | 8/1985 | Brown et al. | |
| 4,909,746 | A * | 3/1990 | Scholz | 439/82 |
| 4,912,401 | A * | 3/1990 | Nady et al. | 324/755 |
| 5,215,472 | A * | 6/1993 | DelPrete et al. | 439/71 |
| 5,374,204 | A * | 12/1994 | Foley et al. | 439/751 |
| 5,575,666 | A * | 11/1996 | Dent | 439/82 |
| 5,982,635 | A * | 11/1999 | Menzies et al. | 361/790 |
| 6,007,348 | A * | 12/1999 | Murphy | 439/70 |
| 6,132,221 | A * | 10/2000 | Matsui et al. | 439/70 |
| 6,155,887 | A * | 12/2000 | Cuff et al. | 439/751 |
| 6,623,280 | B2 * | 9/2003 | Oldenburg et al. | 439/75 |
| 6,899,566 | B2 | 5/2005 | Kline et al. | 439/608 |
| 6,939,143 | B2 | 9/2005 | Rathburn | 439/66 |
| 6,957,963 | B2 | 10/2005 | Rathburn | 439/66 |
| 6,969,286 | B1 | 11/2005 | Mongold et al. | 439/874 |
| 2005/0142908 | A1 | 6/2005 | Harper, Jr. | 439/83 |

OTHER PUBLICATIONS

Mill-Max Mfg. Corp., MILL-MAX® Maximum Connections, Product No. 614-XX-XXX-01-503001, retrieved from http://www.mill.max.com/sockets/so_productinfo.cfm?searchBasicPartNumber=614&searc . . . , 1 page, Aug. 8, 2006.

Mill-Max Mfg. Corp., MILL-MAX® Maximum Connections, Product Specification Questions, Product No. 1109, retrieved from http://www.mill.max.com/pin_rec_catalog/productinfo.cfm?webpart . . . , 2 pages, Jul. 13, 2006.

Mill-Max Mfg. Corp., MILL-MAX® Maximum Connections, Product Specification Questions, Product No. 8894, retrieved from http://www.mill.max.com/pin_rec_catalog/productinfo.cfm?webpart . . . , 2 pages, Jul. 13, 2006.

* cited by examiner

*Primary Examiner*—Tulsidas C. Patel
*Assistant Examiner*—Harshad C Patel

(57) ABSTRACT

A board to board interconnection is provided for interconnection of parallel stacked printed circuit boards, with a like array of plated through holes on each of the boards. One connector assembly is insertable from the outside of one of the stacked printed circuit boards, and another electrical connector assembly is insertable from the opposite side of the stacked parallel boards. One of the connector assemblies includes a compliant portion connectible with a plated through hole and including a socket contact. The other connector includes terminals with compliant portions for interconnection with the other board, and includes a pin terminal extending from the compliant portion which is insertable through the printed circuit boards and into interconnection with the socket of the other electrical connector assembly.

23 Claims, 10 Drawing Sheets

PRINTED CIRCUIT BOARD STACKING CONNECTOR WITH SEPARABLE INTERFACE

FIELD OF THE INVENTION

The enclosed embodiment depicts electrical connectors for interconnection to printed circuit boards, and in particular for stacked board to board interconnections.

BACKGROUND OF THE INVENTION

It is common to provide interconnections to and from printed circuit boards to other devices and or to other printed circuit boards. It is also common place to provide multi-layer printed circuit boards in specific applications. For example, it is common place to provide multi-layer stacked printed circuit boards in such instances as control technology where the boards are stacked one above the other in parallel manner in a closely spaced arrangement, with an insulator providing the insulative spacing between the two printed circuit boards. It is also common to provide printed circuit boards having a like array of plated through holes where the boards are interconnected at each plated through hole by a commoning connection at each of the plated through holes.

One such application has screw machined components having hexagonal, (or other multi-sided configuration) which are press-fit into one of the plated through holes and includes another pin or other interconnection device connected to the press-fit screw machined members. In such applications, the insertion forces for press fitting the screw machined components into the printed circuit board tend to be excessive and cause the screw machine contact and/or the printed circuit board to become damaged during the assembly.

These and other objects are to be accomplished with the following embodiments and teachings.

SUMMARY OF THE INVENTION

The objects were accomplished by providing a board to board interconnect assembly comprising a stamped and formed socket contact having a compliant portion for interconnection to a first printed circuit board plated throughhole and an integral socket portion. A stamped and formed pin contact has a compliant portion for interconnection to a second printed circuit board plated throughhole, and a pin portion for interconnection to the integral socket portion.

In another embodiment of the invention, a board to board interconnect assembly, comprises first and second printed circuit boards positioned in a spaced apart and parallel manner, each printed circuit board having an array of plated through holes, with the arrays in each board being in alignment. A stamped and formed socket contact has an integral socket portion and a compliant portion interconnected to the first printed circuit board plated throughhole. A stamped and formed pin contact has an integral pin portion and a compliant portion interconnected to a second printed circuit board plated throughhole. The pin portion projects through the first printed circuit board, and through the socket compliant portion, to interconnect the pin portion and socket portion.

DETAILED DESCRIPTION OF INVENTION

Figure 1:
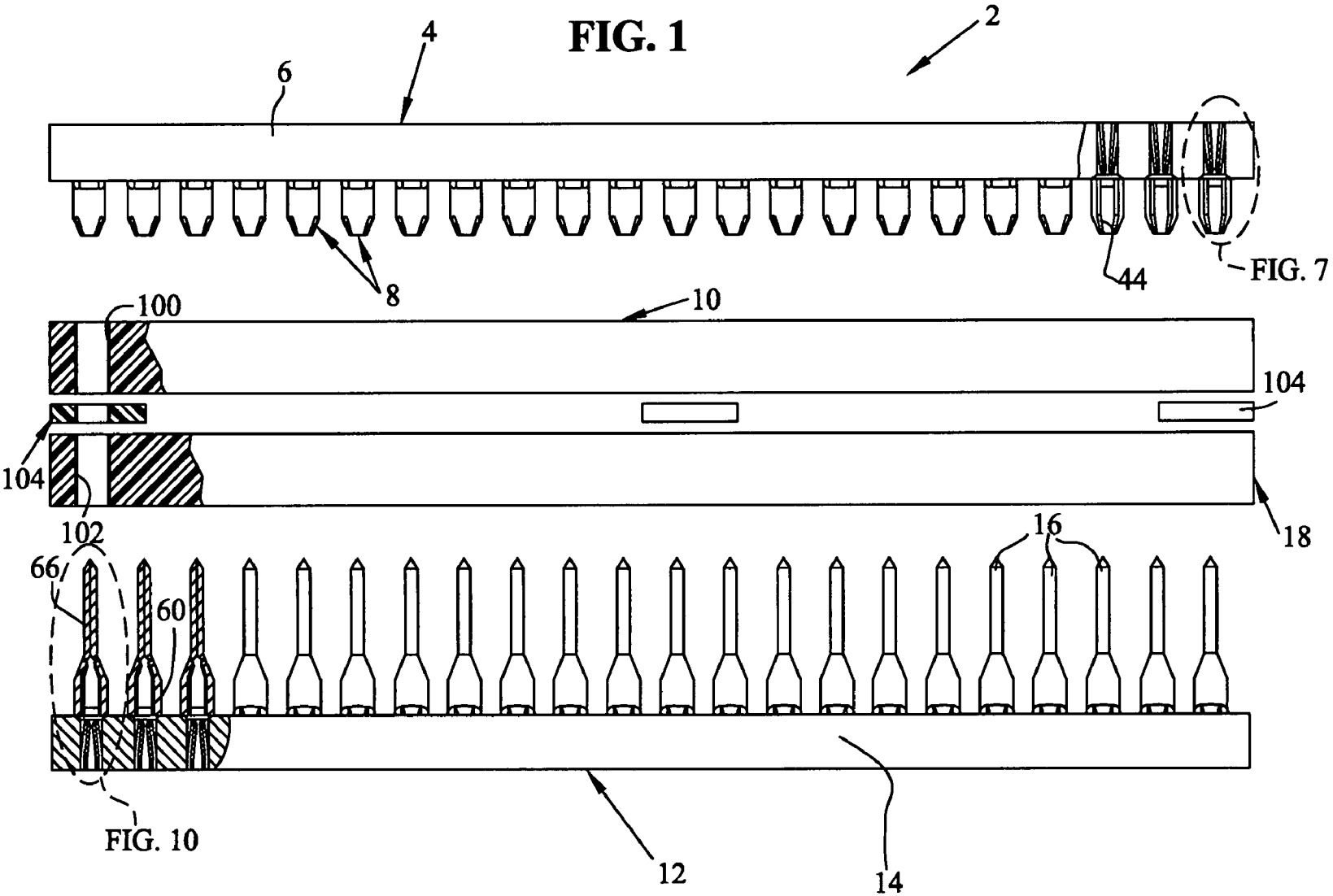
FIG. 1 is a side view of the components of the board to board interconnect shown in a space apart manner and poised for interconnection with each other.

With reference first to FIG. 1, a board to board interconnect assembly is shown generally at 2 which includes a socket assembly 4, having a socket housing 6 and a plurality of socket terminals 8. The socket assembly 6 is shown poised for receipt and interconnection to, a printed circuit board 10. Assembly 2 further includes a pin assembly 12 including a pin housing 14 and a plurality of pin terminals 16. Pin assembly 12 is shown poised for receipt and interconnection to a printed circuit board 18.

Figure 2:
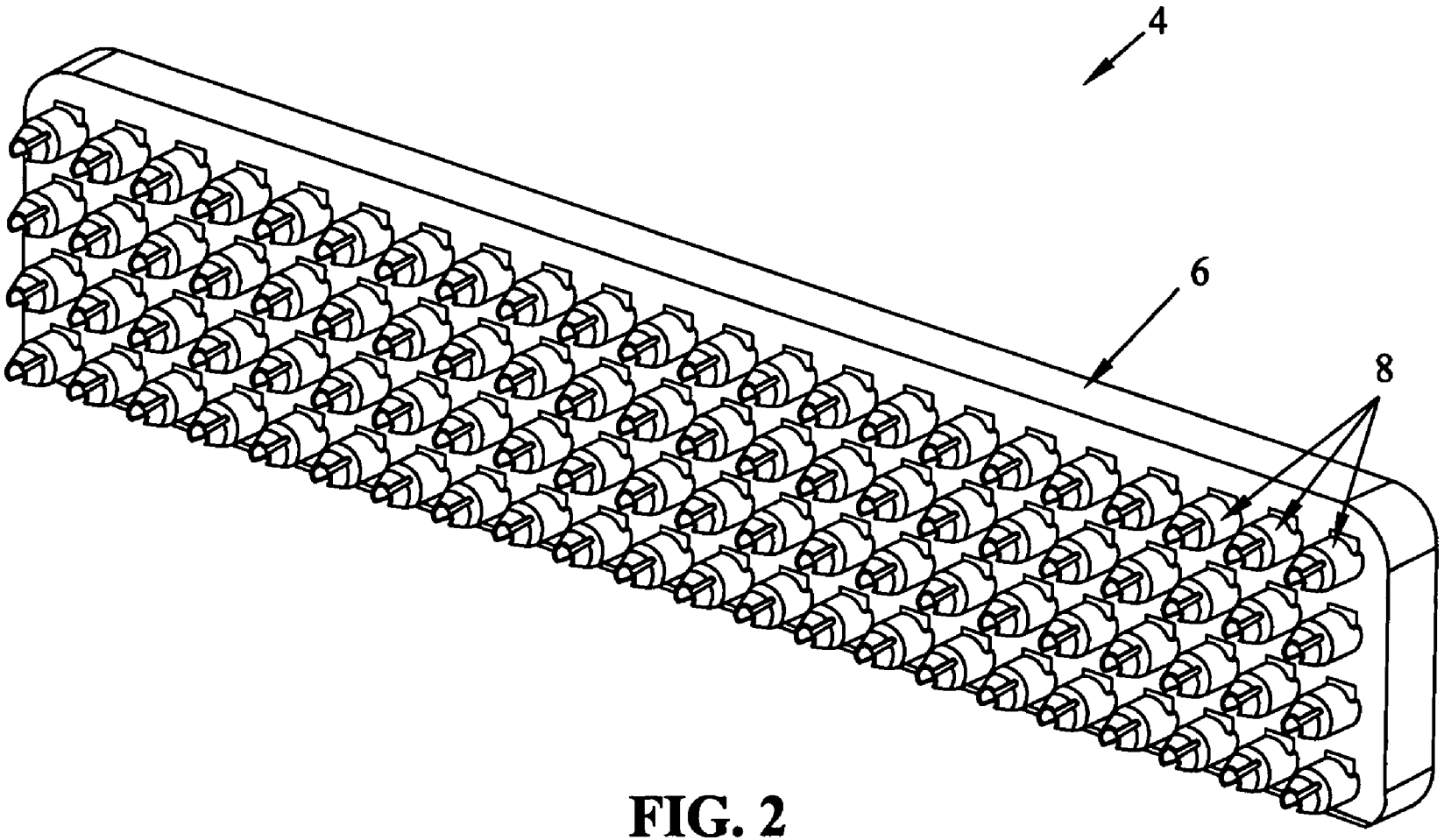
FIG. 2 shows an underside perspective view of the socket assembly of FIG. 1.
Figure 3:
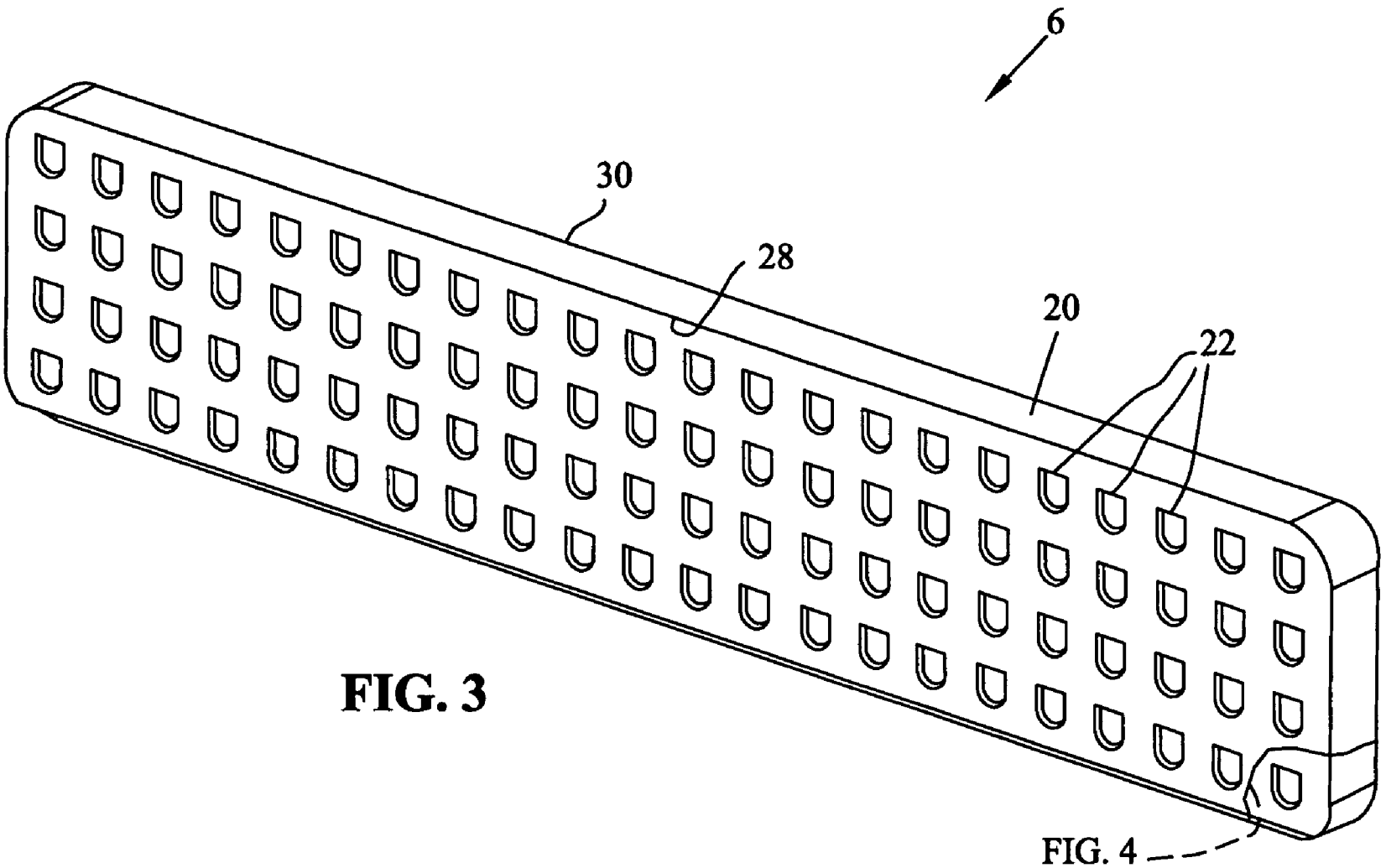
FIG. 3 shows a perspective view similar to that of FIG. 2, of the housing without the socket contacts.
Figure 4:
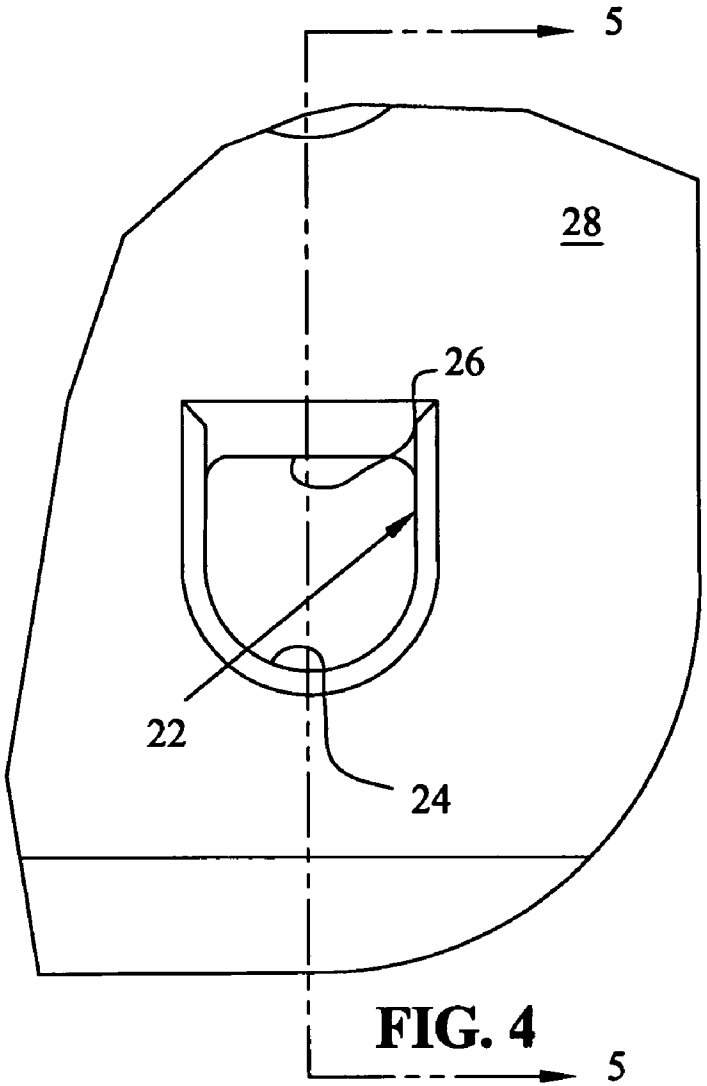
FIG. 4 is an enlarged view of the portion denoted in FIG. 3.
Figure 5:
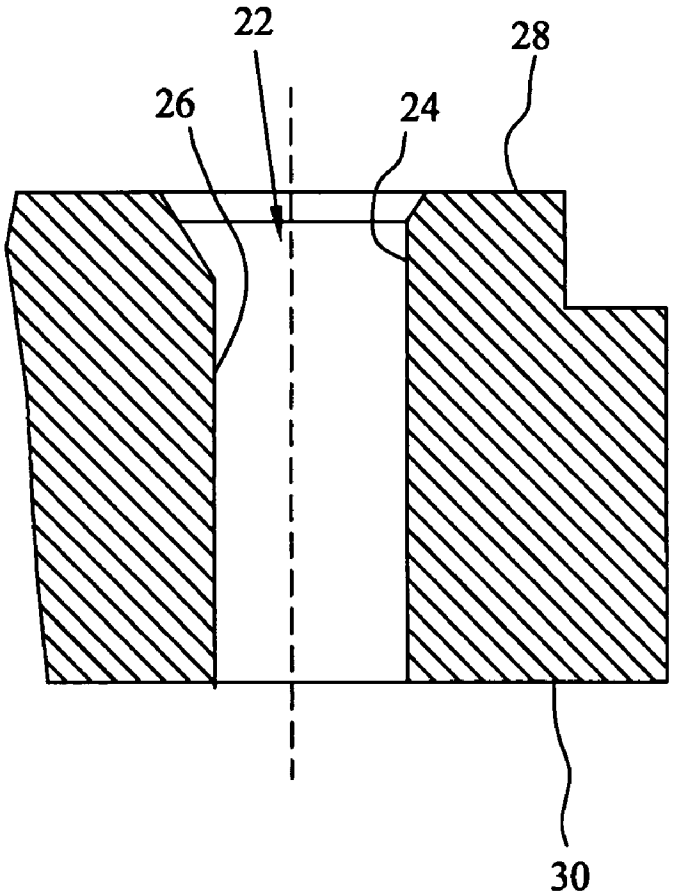
FIG. 5 is a cross-sectional view through lines 5—5 of FIG. 4.

With reference now to FIG. 2, socket assembly 4 is shown in greater detail as including a plurality of columns and rows of socket terminals 8 defining an array of socket terminals. With reference to FIGS. 3 and 4, socket housing 6 is shown in greater detail where socket housing 6 is comprised an insulative plate member 20 having a plurality of openings at 22. As shown in FIG. 4, openings 22 include a U-shaped portion at 24 and a flat sidewall portion 26. As shown in FIGS. 3–5, openings 22 extend between an internal face 28 and an external face 30.

Figure 6:
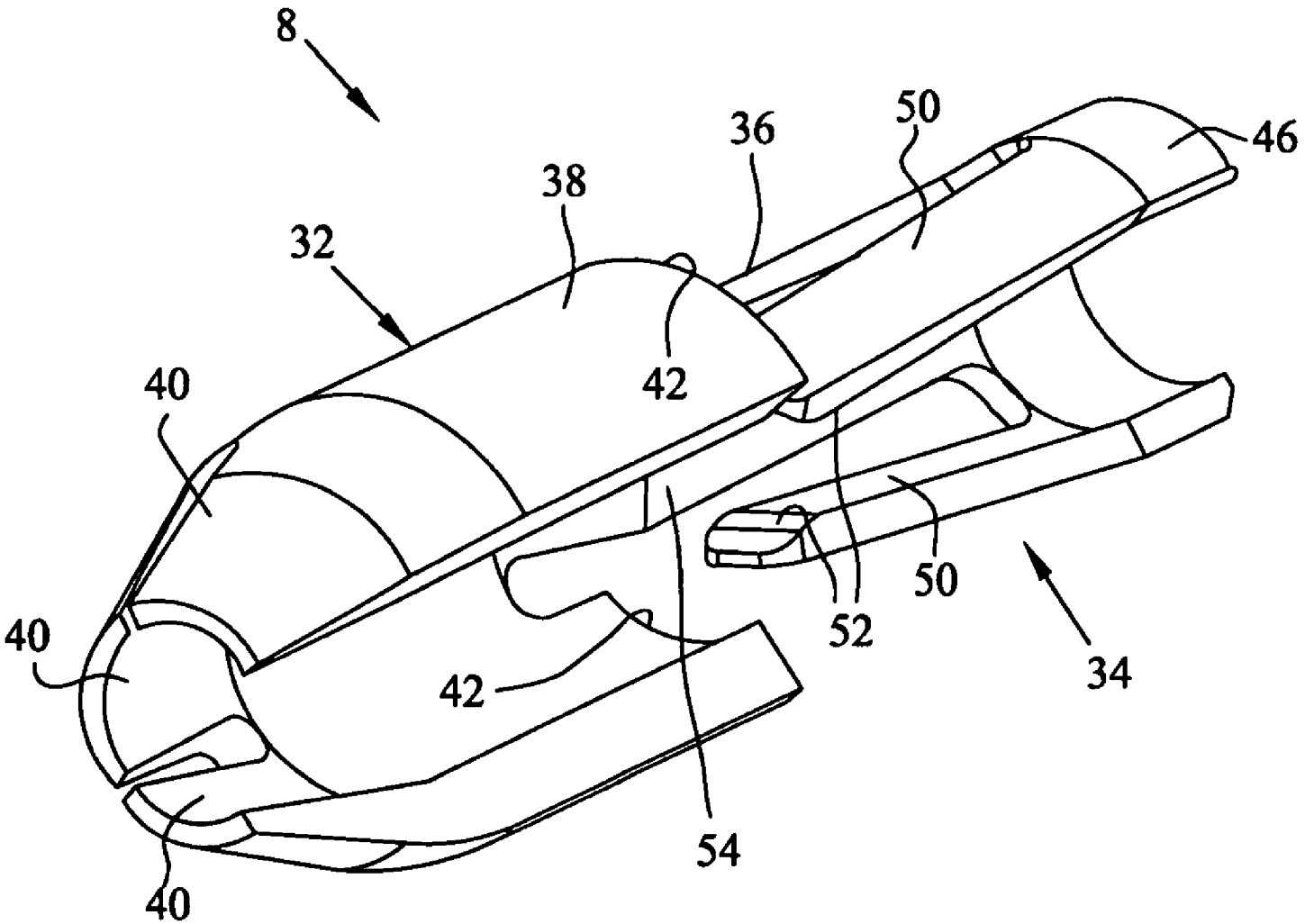
FIG. 6 is a perspective view of the socket contact of the present invention.

With reference now to FIG. 6, socket terminals 8 are shown including compliant portions 32 integrally connected to socket portions 34 by way of an integral strap 36. As shown, compliant portions 32 include a C-shaped cross section around a body portion 38 which necks down into lead in portions 40 as described herein. As also shown in FIG. 6, body portion 38 of compliant portion 32 includes an upper engaging surface 42 as will be described herein. Socket portion 34 includes a C-shaped retaining portion 46 having socket beams 50 extending downwardly from the retaining portion 46. As shown socket beams are deflected inwardly to form a constricted portion between contact surfaces 52 of socket beams 50 and with a contact surface portion 54 of strap 36.

Figure 7:
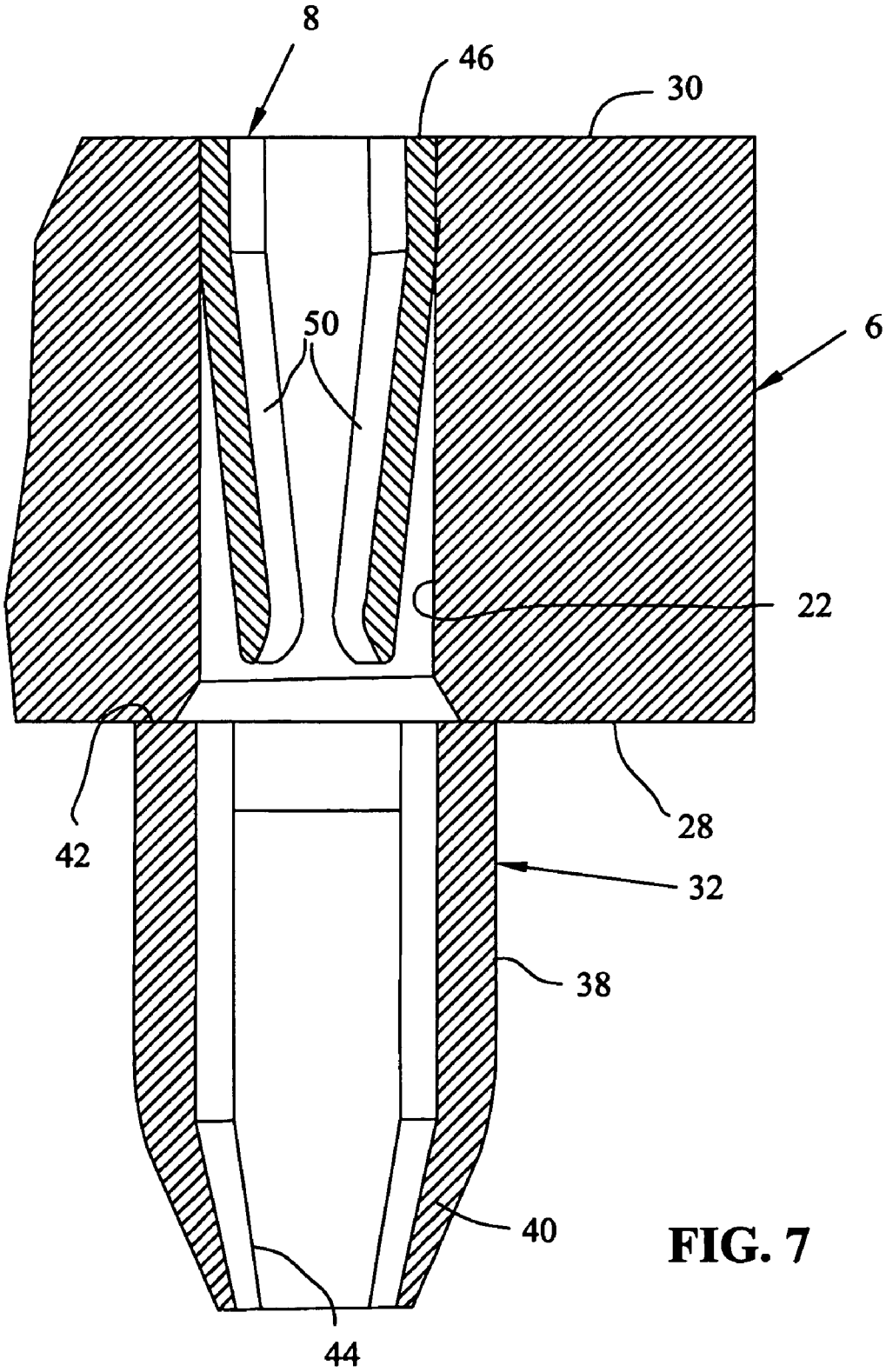
FIG. 7 is an enlarged view of the portion denoted in FIG. 1.

Thus socket terminals 8 may be positioned in openings 22 with retaining portions 46 being positioned in openings 22, and with the socket beams 50 depending downwardly as shown in FIG. 7. As also shown, body portion 38 is a larger diameter than opening 22 and thus engaging surface 42 abuts inner face 28 of socket housing 6.

Figure 8:
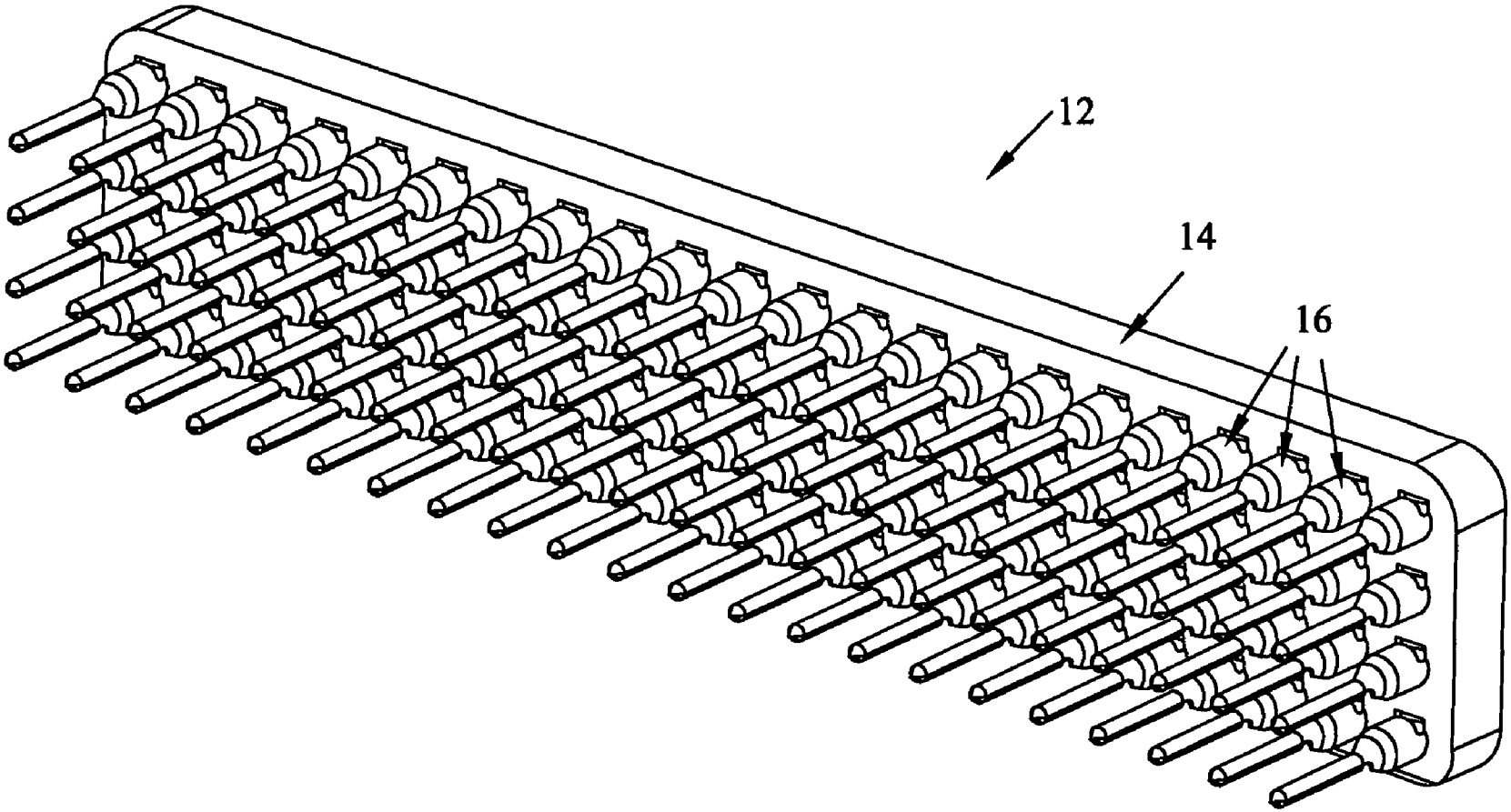
FIG. 8 is an underside perspective of the pin assembly shown in FIG. 1.

With respect now to FIG. 8, pin assembly 12 is shown with a plurality of pin terminals 16 positioned in a plurality of columns and rows defining an array of pin terminals 16. It should be appreciated that the arrays of the pin terminals 16 and the array of socket terminals 8 are substantially identical in order to provide mating engagement between the two. It should also be appreciated that pin housing 14 is substantially identical to socket housing 6, and therefore pin housing 14 will not be described in detail herein.

Figure 9:
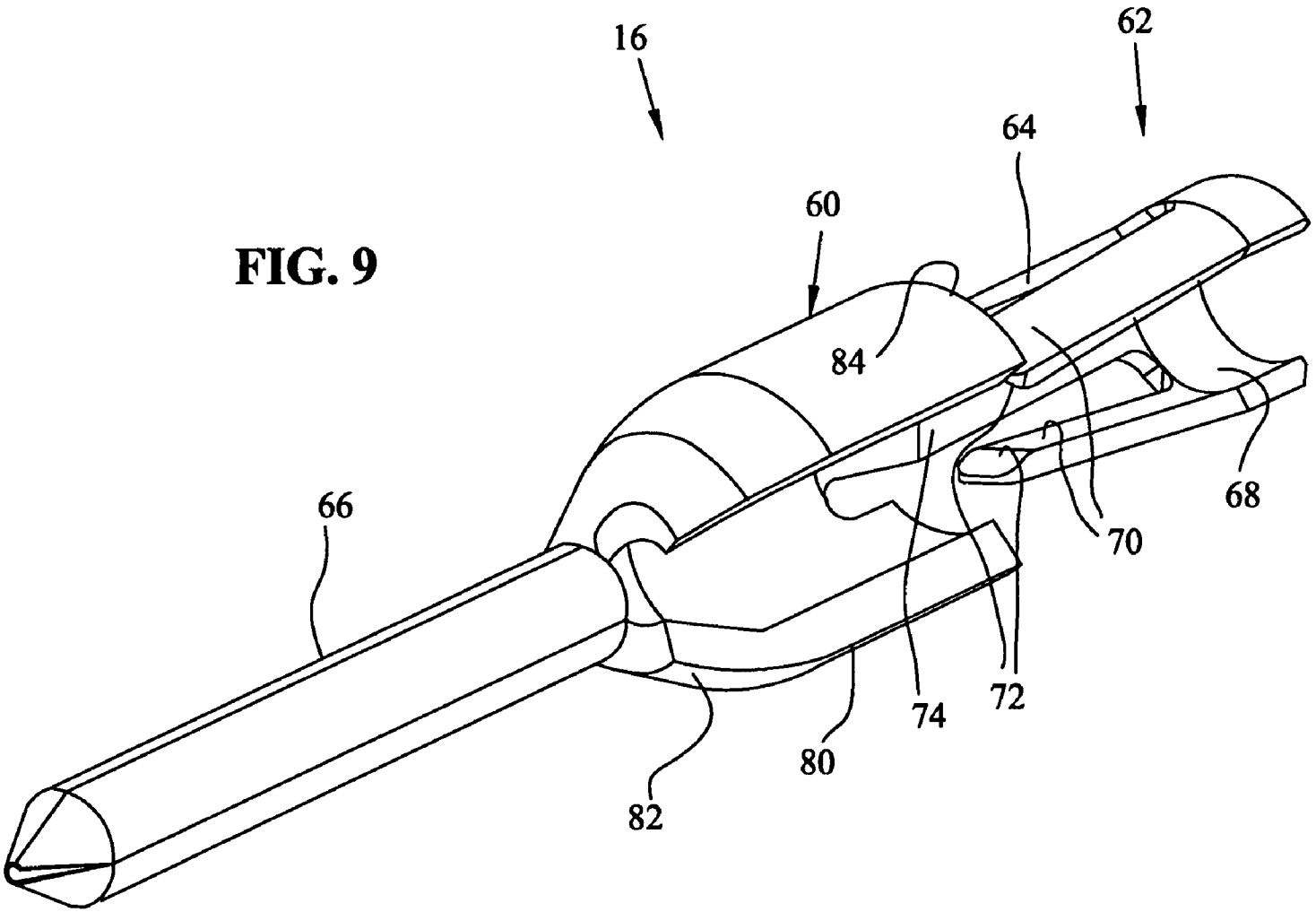
FIG. 9 is a perspective view of one of the pin contacts of FIG. 8.

With respect now to FIG. 9, pin terminals 16 will now be described. Pin terminals 16 includes compliant portion 60 having a socket portion 62 integrally attached by way of strap portion 64. Furthermore pin portion 66 is integrally attached to compliant portion 60 from the opposite end as the socket portion 62. Socket portion 62 includes a C-shaped retaining portion 68 in the way of a compliant C-shaped member, having socket beams 70 extending downwardly therefrom. Socket portion 62 defines a three point contact by way of contact surfaces 72 of socket beams 70, and by way of contact surface portion 74 on strap portion 64. Furthermore, compliant portion 60 includes a body portion 80 of C-shaped configuration on the cross section together with a lead in portion at 82, and an engaging portion at 84.

Figure 10:
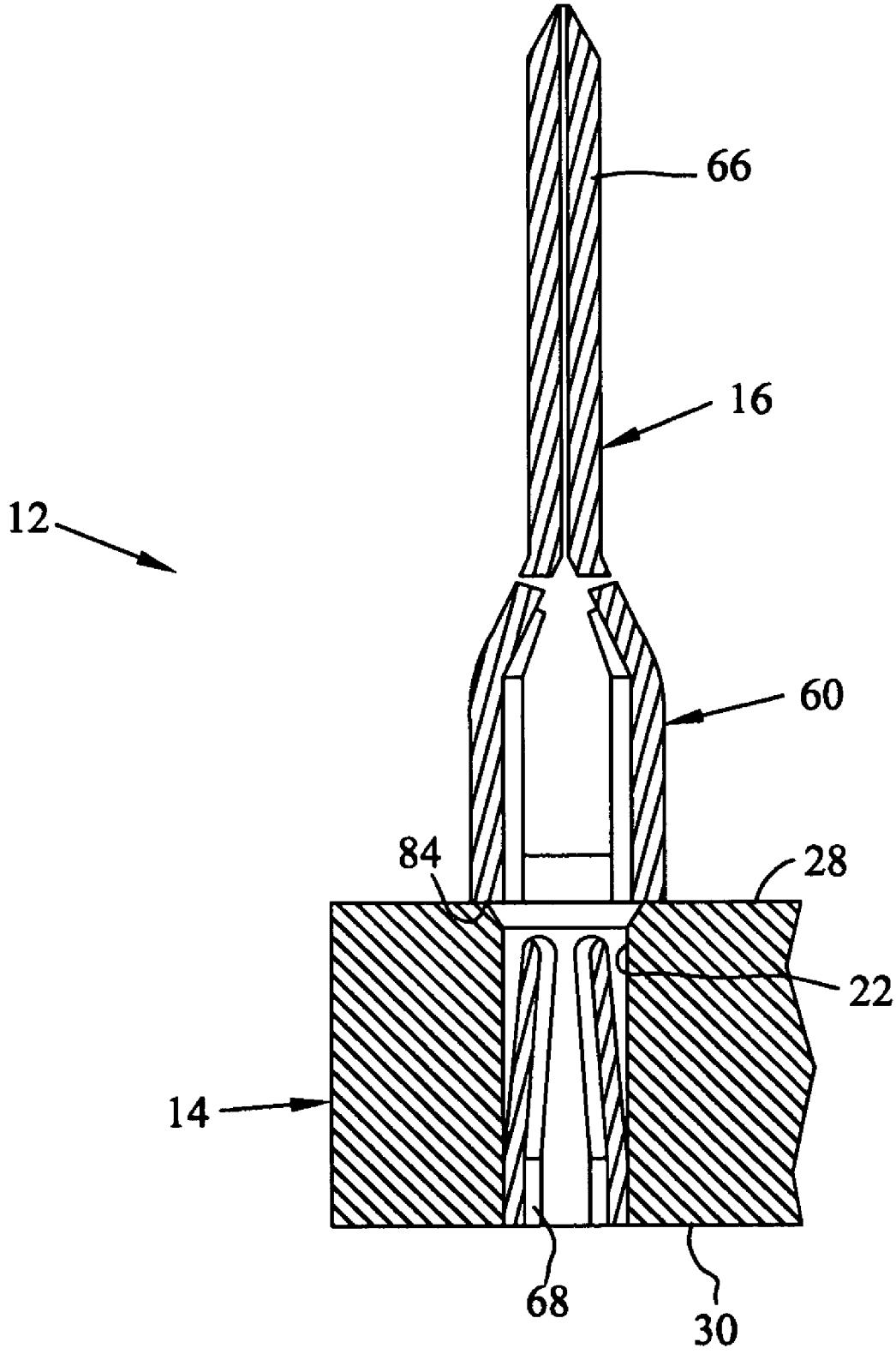
FIG. 10 is an enlarged view of the portion denoted in FIG. 1.

Thus, as shown in FIG. 10, pin terminals 16 are situated in pin housing 14 with the C-shaped retaining portions 68 maintaining the pin terminals 16 in openings 22 with the compliant portion 60 and the pin portion 66 exterior to pin housing 14, and with the engaging surface 84 in abutment with internal face 28. Thus, it is the socket assembly 4 in the configuration of FIG. 7 and the pin assembly 12 in the configuration of FIG. 10 which allow for the interconnection of the two assemblies 4, 12 and the two printed circuit boards 10 and 18 to be interconnected together. As shown in FIG. 1, printed circuit board 10 includes a plurality of plated through holes 100 (only one of which is shown) however it should be appreciated that the through holes 100 have a like array as the array of socket terminals 8. Furthermore circuit board 18 is shown poised over pin assembly 12 where printed circuit board 18 has a plurality of plated through holes 102 (only one of which is shown) for interconnection to pin assembly 12. FIG. 1 also shows multiple spacers such as 104 positioned between the two circuit boards 10, 18. These spacers are intended to insulate the two boards 10, 18 and their components from each other. While shown as washers or grommets, it should be appreciated that this insulation could also be in the form of a sheet gasket, or any other spacer.

Figure 11:
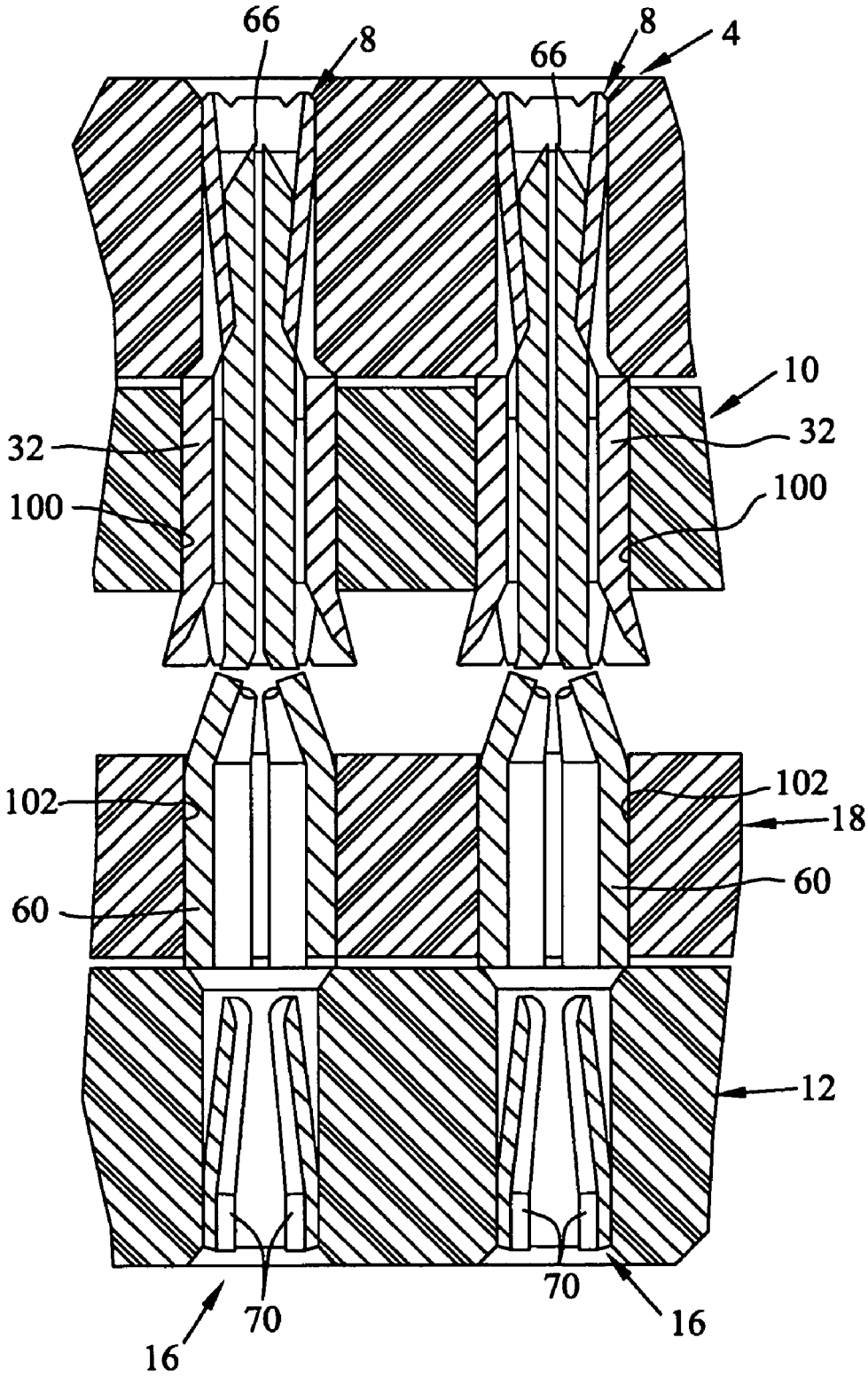
FIG. 11 is a cross-sectional view similar to that of FIG. 1 showing the board to board inner connect in its fully mated condition.

To make the interconnection, one of the boards 10 or 18 is positioned over its respective assembly 4 or 12. For example, and with respect again to FIG. 1, printed circuit board 10 is positioned with the plurality of plated through holes 100 to be positioned over the compliant portions 32 which retains and electrically connects the socket terminals 8 to the plated through holes 100. During insertion into the PCB, the lead-in portions (40) of the socket contact flare open to allow for ease of mating to pin (66). Meanwhile printed circuit board 18 can be positioned with the plated through holes over pins 66 and in interconnection with compliant portions 60 which causes pins 66 to project out of plated through holes 102. As shown in FIG. 11, the two assemblies may now be brought together, such that pins 66 protrude into openings 44 (FIG. 7) of the socket terminals 8 and the pin portions 66 extends upwardly through compliant portion 32, to make contact with socket beams 50 and the kinked contact surface 54 (FIG. 6).

Thus, a very inexpensive interconnect has been provided, for the placement of two printed circuit boards in a back to back manner for interconnecting the two boards together. It should also be appreciated from FIG. 1, 10 or 11 that a further interconnection could be made with the socket beams 70 of pin terminal 16 for further electrical interconnection.

What is claimed is:

1. A board to board interconnect assembly, comprising:

a stamped and formed socket contact having a compliant portion for interconnection to a first printed circuit board plated throughhole and an integral socket portion; and a stamped and formed pin contact having a compliant portion for interconnection to a second printed circuit board plated throughhole;

the compliant portion of the stamped and formed socket contact being profiled to receive therethrough the stamped and formed pin contact, wherein an electrical connection is made between the stamped and formed pin contact and the integral socket portion.

2. The board to board interconnect assembly of claim 1, further comprising a socket housing for housing the stamped and formed socket contact.

3. The board to board interconnect assembly of claim 2, further comprising a pin housing for housing the stamped and formed pin contact.

4. The board to board interconnect assembly of claim 3, wherein said integral socket portion is positioned in an opening of said socket housing, with said compliant portion of said socket contact being positioned on the exterior of said socket housing.

5. The board to board interconnect assembly of claim 4, wherein said stamped and formed pin contact further comprises a retaining portion for retaining said pin contact to said pin housing.

6. The board to board interconnect assembly of claim 5, wherein a pin portion extends from one end of said compliant portion of said pin contact and said retaining portion of said pin contact extends from an opposite end of said compliant portion of said pin contact.

7. The board to board interconnect assembly of claim 6, wherein said retaining portion is positioned in an opening of said pin housing, with said compliant portion of said pin contact being positioned on the exterior of said housing, and the pin portion extending from said compliant portion.

8. The board to board interconnect assembly of claim 7, wherein said socket housing and socket contact are connectable to said first printed circuit board, with said socket contact compliant portion being positioned in the plated through hole of said first printed circuit board.

9. The board to board interconnect assembly of claim 8, wherein said socket contact compliant portion comprises an opening through an end thereof to access said socket portion.

10. The board to board interconnect assembly of claim 9, wherein said pin housing and pin contact are connectable to said second printed circuit board, with said pin contact compliant portion being positioned in the plated through hole of said second printed circuit board, and with said pin projecting therefrom.

11. The board to board interconnect assembly of claim 10, wherein the first and second printed circuit boards may be placed adjacent to each other in a spaced apart, parallel manner; with said pin projecting through said first printed circuit board, and through said compliant portion opening, to interconnect said pin portion and socket portion.

12. The board to board interconnect assembly of claim 1, wherein said stamped and formed pin contact further comprises a pin portion for interconnection to said integral socket portion and an integral socket portion for further electrical interconnection.

13. The assembly of claim 1, wherein receiving the compliant portion of the pin contact within the compliant portion of the socket contact couples the first printed circuit board to the second printed circuit board.

14. A board to board interconnect assembly, comprising:

first and second printed circuit boards positioned in a spaced apart and parallel manner, each printed circuit board having an array of plated through holes, with said arrays in each board being in alignment;

a stamped and formed socket contact having an integral socket portion and a compliant portion interconnected to said first printed circuit board plated throughhole;

a stamped and formed pin contact having an integral pin portion and a compliant portion interconnected to a second printed circuit board plated throughhole; and said pin portion projecting through said first printed circuit board, and through said socket compliant portion, to interconnect said pin portion and socket portion.

15. The board to board interconnect assembly of claim 14, further comprising a socket housing for housing the stamped and formed socket contact.

16. The board to board interconnect assembly of claim 15, further comprising a pin housing for housing the stamped and formed pin contact.

17. The board to board interconnect assembly of claim 16, wherein said integral socket portion is positioned in an opening of said socket housing, with said compliant portion of said socket contact being positioned on the exterior of said socket housing.

18. The board to board interconnect assembly of claim 17, wherein said stamped and formed pin contact further comprises a retaining portion for retaining said pin contact to said pin housing.

19. The board to board interconnect assembly of claim 18, wherein said pin portion extends from one end of said compliant portion of the pin contact and said retaining portion extends from an opposite end.

20. The board to board interconnect assembly of claim 19, wherein said retaining portion is positioned in an opening of said pin housing, with said compliant portion of said pin contact being positioned on the exterior of said housing, and the pin portion extending from said compliant portion.

21. The board to board interconnect assembly of claim 20, wherein said socket housing and socket contact are connectable to said first printed circuit board, with said socket contact compliant portion being positioned in the plated through hole of said first printed circuit board.

22. The board to board interconnect assembly of claim 21, wherein said pin housing and pin contact are connectable to said second printed circuit board, with said pin contact compliant portion being positioned in the plated through hole of said second printed circuit board, and with said pin projecting therefrom.

23. The board to board interconnect assembly of claim 14, wherein said stamped and formed pin contact further comprises a pin portion for interconnection to said integral socket portion and an integral socket portion for further electrical interconnection.

* * * * *